US007938679B2

(12) United States Patent
Wadsworth et al.

(10) Patent No.: US 7,938,679 B2
(45) Date of Patent: May 10, 2011

(54) ELECTRONIC DEVICE OR POWER STRIP WITH ACTIVE CLAMPING

(75) Inventors: John F. Wadsworth, Burbank, CA (US); Kenneth Mori, Los Angeles, CA (US)

(73) Assignee: Belkin International, Inc., Playa Vista, CA (US)

( * ) Notice: Subject to any disclaimer, the term of this patent is extended or adjusted under 35 U.S.C. 154(b) by 547 days.

(21) Appl. No.: 12/049,981

(22) Filed: Mar. 17, 2008

(65) Prior Publication Data

US 2009/0032660 A1 Feb. 5, 2009

Related U.S. Application Data

(60) Provisional application No. 60/962,847, filed on Jul. 31, 2007.

(51) Int. Cl.
*H01R 13/60* (2006.01)

(52) U.S. Cl. ..... 439/574

(58) Field of Classification Search ..... 439/574, 439/575, 535; 379/446
See application file for complete search history.

(56) References Cited

U.S. PATENT DOCUMENTS

| | | | | |
|---|---|---|---|---|
| 2,271,463 | A | 1/1942 | Reeves | |
| 2,647,713 | A | 8/1953 | Wersching | |
| 2,716,531 | A | 8/1955 | Johnson | |
| 3,006,589 | A | 10/1961 | Drysdale | |
| 3,049,688 | A | 8/1962 | Sinopoli | |
| 3,249,351 | A * | 5/1966 | Smith | 269/236 |
| 3,250,030 | A | 5/1966 | Lapastora | |
| 3,297,886 | A | 1/1967 | Danner | |
| 3,473,767 | A | 10/1969 | Schwaneke | |
| 4,206,910 | A | 6/1980 | Biesemeyer | |
| 4,398,647 | A | 8/1983 | Ackerman | |
| 4,502,668 | A | 3/1985 | Dodge, Jr. | |
| 4,747,788 | A | 5/1988 | Byrne | |
| 4,792,881 | A | 12/1988 | Wilson et al. | |
| 4,795,141 | A | 1/1989 | Mulvaney | |
| 4,854,016 | A * | 8/1989 | Rice | 24/495 |
| 4,875,878 | A | 10/1989 | Meyer | |
| 4,944,694 | A | 7/1990 | Dorn | |
| 5,024,406 | A * | 6/1991 | Ketcham | 248/149 |
| 5,057,039 | A * | 10/1991 | Persing et al. | 439/574 |
| 5,176,343 | A | 1/1993 | Cheney et al. | |
| 5,364,084 | A | 11/1994 | Karash | |
| 5,401,011 | A | 3/1995 | Gatenby et al. | |
| 5,402,972 | A | 4/1995 | Schmidt | |
| 5,472,157 | A | 12/1995 | Lehrman | |
| 5,702,075 | A | 12/1997 | Lehrman | |
| 5,825,874 | A * | 10/1998 | Humphreys et al. | 379/446 |
| 5,836,563 | A * | 11/1998 | Hsin-Yung | 248/316.4 |

(Continued)

*Primary Examiner* — T C Patel
*Assistant Examiner* — Harshad C Patel
(74) *Attorney, Agent, or Firm* — Bryan Cave LLP

(57) ABSTRACT

Active clamping of an electronic device such as a power strip to the edge of a desk, table, or board featuring at least one force-redirecting mechanism comprising one, two, four, or more moving parts and biasing mechanisms that bias the moving parts into contact with the edge, such that a frictional force increases a clamping force to resist removal of the device from the edge. Different embodiments feature a roller, a ramp, and springs, or cams and springs. In some embodiments, one or two arms project from a housing of the device, which define or form a void configured to engage the edge, and, in certain embodiments, one of the arms has a pivot mount and a release mechanism, or a rotatable knob and clamp. Various embodiments feature a housing containing electronic components such as surge suppression components, power receptacles, a cord, a status indicator, pins, and elastomeric surfaces.

25 Claims, 6 Drawing Sheets

U.S. PATENT DOCUMENTS 5,899,761 A 5/1999 Crane et al.
5,964,618 A 10/1999 McCarthy
6,004,157 A * 12/1999 Glass ..... 439/574
6,010,102 A 1/2000 Dillion, Jr.
6,098,859 A 8/2000 Bortner
6,174,199 B1 1/2001 Rushing
6,179,665 B1 1/2001 Rossman et al.
6,183,280 B1 2/2001 Laukhuf
6,229,691 B1 5/2001 Tanzer et al.
6,234,812 B1 5/2001 Ivers et al.
6,243,257 B1 6/2001 Ester
6,300,570 B1 10/2001 Lai
6,315,604 B1 11/2001 Lee
6,379,182 B1 4/2002 Byrne
6,435,461 B1 8/2002 Saylor et al.
6,540,554 B2 * 4/2003 McCarthy ..... 439/574
6,589,073 B2 7/2003 Lee
6,642,450 B1 11/2003 Hsiao
6,713,674 B2 3/2004 Chang
6,717,053 B2 4/2004 Rupert
6,748,707 B1 6/2004 Buchalter et al.
6,752,653 B1 6/2004 Morlock et al.
6,785,567 B2 * 8/2004 Kato ..... 455/575.9
6,811,281 B1 11/2004 Hsiao
6,848,662 B2 * 2/2005 Paramonoff et al. ..... 248/309.1
6,885,796 B2 4/2005 Lubkert et al.
6,897,379 B1 5/2005 Hsiao
7,080,812 B2 * 7/2006 Wadsworth et al. ..... 248/316.6
7,083,421 B1 * 8/2006 Mori ..... 439/574
7,223,122 B2 5/2007 Mori
2002/0119698 A1 * 8/2002 McCarthy ..... 439/574
2004/0035992 A1 2/2004 Watts
2007/0049079 A1 * 3/2007 Nalwad et al. ..... 439/137
2007/0159756 A1 7/2007 Moffatt

* cited by examiner

ELECTRONIC DEVICE OR POWER STRIP WITH ACTIVE CLAMPING

CLAIM OF PRIORITY

This patent application claims priority to U.S. provisional patent application No. 60/962,847 filed on Jul. 31, 2007, titled "Electrical Connectivity System".

FIELD OF THE INVENTION

This Invention relates to mechanisms for attaching electronic devices, such as power strips, to the edges of desks, tables, and boards (for example), and to electronic devices and power strips featuring such mechanisms.

BACKGROUND OF THE INVENTION

Electronic devices such as power strips have been used in the vicinity of desks and tables and have been used in environments having exposed boards present such as construction environments, shops, garages, and the like. It is known to attach electronic devices such as power strips to the edges of desks, tables, and boards, for instance, and various mechanisms have been used or invented for such purposes. U.S. Pat. Nos. 7,083,421 and 7,223,122, both by Kenneth Mori, describe certain examples. The '122 patent describes using a bracket and fasteners, such as screws, bolts, or a combination thereof, to mount an electronic device to an object, such as a desk or table. Additionally, clamps have been used to accomplish such attachments, and the '421 patent illustrates an electronic device that includes a mounting mechanism that clamps the electronic device over the edge of a desk or table, for example.

However, fasteners require holes to be drilled into the desk or table, and prior art clamps have required that sufficient force be exerted on the desk or table to overcome the worst-case scenario force tending to remove the electronic device from the desk or table. In some cases, some users were not strong enough to provide sufficient force on the clamp to accomplish the ideal clamping force, while other users were too strong, and applied excessive force or damaged the clamp or electronic device. In some instances, when excessive force was applied with a prior art clamp, the desk or table may have been damaged.

Thus, needs or potential for benefit exist for mechanisms for attaching electronic devices such as power strips to the edge of a desk table, or board, that provide only the amount of force against the desk, table, or board, that is required to hold the electronic device in place, or a reduced amount of such force that varies based on need. In addition, needs or potential for benefit exist for mechanisms for attaching electronic devices such as power strips to the edge of a desk, table, or board, that provide more consistent application of force against the desk, table, or board, independent of the strength of the user that installs the device. Furthermore, needs or potential for benefit exist for mechanisms for attaching electronic devices such as power strips to the edge of a desk, table, or board, that avoid damaging, or reduce the risk of damaging, the surface of the desk, table, or board, for instance.

Moreover, needs and potential for benefit exist for such mechanisms and devices (such as power strips) incorporating such mechanisms that are inexpensive to manufacture, reliable, easy to use, that have a long life, that are simple in operation so that typical operators can effectively use them, and that attach to a desk, table, or board (for example) adequately securely. Room for improvement exists over the prior art in these and other areas that may be apparent to a person of ordinary skill in the art having studied this document.

SUMMARY OF PARTICULAR EMBODIMENTS OF THE INVENTION

This invention provides, among other things, certain electronic devices, power strips, mechanisms for clamping to the edge of a desk, table, or board, and devices with such mechanisms, with particular features or capabilities. Various embodiments provide, as objects or benefits, for example, that they have (or consist of) mechanisms for attaching electronic devices such as power strips to the edge of a desk, table, or board (for example), that avoid damaging the desk, table or board. Some embodiments provide only the amount of force against the desk, table, or board, that is required to hold the electronic device in place, or provide a reduced amount of force in comparison with other alternatives.

In some embodiments, the amount of clamping force may change in response to forces tending to remove the device from the edge of the desk, table, or board, for example. In addition, certain embodiments of the invention provide or include mechanisms for attaching electronic devices such as power strips to the edge of a desk, table, or board, for example, that provide more consistent application of force against the desk, table, or board, independent of the strength of the user that installs the device, for instance. Furthermore, various embodiments provide such mechanisms and devices (such as power strips) or incorporating such mechanisms that are inexpensive to manufacture, reliable, easy to use, that have a long life, that attach to a desk, table, or board (for example) sufficiently securely, and that are simple in operation so that typical operators can effectively use them. Other benefits of certain embodiments may be apparent to a person of ordinary skill in the art.

In specific embodiments, this invention provides certain electronic devices that are configured to attach to and be mounted on an edge of a desk, table, or board, for example. In a number of embodiments, such an electronic device may include a housing containing electronic components which may include, for example, multiple electrical conductors. Such an electronic device may also include a void configured to engage the edge of the desk, table, or board, for instance, and such a void may be defined by a first portion of the electronic device, a second portion of the electronic device, and a third portion of the electronic device. In a number of such embodiments, the second portion extends from the first portion to the third portion, the first portion is opposite of the third portion, and the void is between the first portion and the third portion. Further, in various embodiments, the first portion or the third portion (or both) may include a first force-redirecting mechanism. This mechanism may include a first moving part and a first biasing element configured to bias the first moving part into contact with the edge of the desk, table, or board, for example, when the edge is in the void.

In a number of embodiments, the first moving part and first force-redirecting mechanism are configured such that a first frictional force acting between the edge and the first moving part, when the electronic device is biased in a direction away from the edge, (e.g., in a direction such that the second portion of the electronic device is biased away from the edge), causes the first moving part to bias toward the edge, thereby increasing the clamping force between the first moving part and the edge, and thereby increasing the first frictional force acting between the edge and the first moving part. This redirection of forces may act to resist the removal of the electronic device from the edge of the desk, table, or board, for example.

In some embodiments, the electronic device is a power strip, for example, that may include multiple electrical receptacles and a power cord, for instance. And in certain embodiments, the electronic is a surge suppressor, and includes electronic surge suppressor components. Further, in a number of embodiments, the electronic device may further include a first arm projecting from the housing, and the first arm may form the first portion of the electronic device. Furthermore, in some embodiments, the electronic device may further include a second arm projecting from the housing, and the second arm may form the third portion of the electronic device, in particular embodiments. In certain of these embodiments, the first force-redirecting mechanism is located in the first arm, for example. Moreover, in particular such embodiments, the first moving part has a limited range of motion, the electronic device includes a pin, and the pin limits the range of motion of the first moving part.

In addition, in some embodiments, the first portion or the third portion (or both) include a second force-redirecting mechanism which may include a second moving part and a second biasing element configured to bias the second moving part into contact with the edge of the desk, table, or board, when the edge is in the void, for example. In some such embodiments, the second moving part and second force-redirecting mechanism are configured such that a second frictional force acting between the edge and the second moving part, for instance, when the electronic device is biased in a direction away from the edge (e.g., such that the second portion of the electronic device biases in a direction away from the edge), causes the second moving part to bias toward the edge. This may further increase the clamping force between the second moving part and the edge, and thereby increase the second frictional force acting between the edge and the second moving part, which may further resist the removal of the electronic device from the edge of the desk, table, or board.

In certain such embodiments, the first moving part is a first cam that rotates about an axis, for example. Some such embodiments have the second force-redirecting mechanism including the second moving part, which may be a second cam that also rotates about an axis. In various embodiments, the electronic device may further include the first arm projecting from the housing, such that the first arm forms the first portion of the electronic device, and the first cam and the second cam may be located within the first arm, for example. In particular embodiments, the electronic device may further include the second arm projecting from the housing, and the second arm may form the third portion of the electronic device. In certain embodiments, the second arm includes a pivot mount.

On the other hand, in other embodiments, the first moving part is a roller that rolls on an inclined surface, and the inclined surface is inclined relative to the first portion, the third portion, or both. In some such embodiments, the roller comprises a tubular elastomeric exterior, for example, surrounding a round inner pin, and the pin may have a substantially higher modulus of elasticity than the elastomeric exterior. In particular embodiments, the pin extends beyond the tubular elastomeric exterior on each end of the roller, and each end of the pin is contained within a substantially triangular space in the housing, for instance. In addition (or instead), in some embodiments, the first biasing element comprises two helical springs which press against two ends of the pin, biasing the roller against the inclined surface and into the void. In some of these embodiments, the electronic device may further include an adjustable clamp that includes a first member that is threaded with external helical threads, a second member that is threaded with internal helical threads that are configured to mate with the external helical threads, and a rotatable knob, for example, for adjusting the clamp.

Other embodiments of the invention specifically provide a power strip that is configured to attach to and be mounted on an edge of a desk, table, or board, for example. Such a power strip may include, for instance, a housing containing electronic components including multiple electrical conductors and multiple electrical receptacles, a power cord electrically connected to the electronic components and physically attached to the power strip, and a first arm projecting from the housing. Some such power strip embodiments further include, for example, a roller that rolls on an inclined surface, and at least one biasing element positioned and configured to bias the roller against the inclined surface and away from the housing or the arm. Other embodiments include two cams (e.g., within the first arm of the power strip) and a second arm having a pivot mount projecting from the housing, as another example.

Many of these embodiments, further include a void configured to engage the edge of the desk, table, or board, for instance. Similar to other embodiments, in a number of these embodiments, the void is defined by a first portion of the power strip, a second portion of the power strip, and a third portion of the power strip, and the second portion extends from the first portion to the third portion, the first portion is opposite of the third portion, and the void is between the first portion and the third portion. In a number of embodiments, the first arm forms the first portion of the power strip, and in some embodiments, the second arm forms the third portion of the power strip, for instance. Certain embodiments further include other features described above for the power strips. In addition, various other embodiments of the invention are also described herein.

Figure 1:
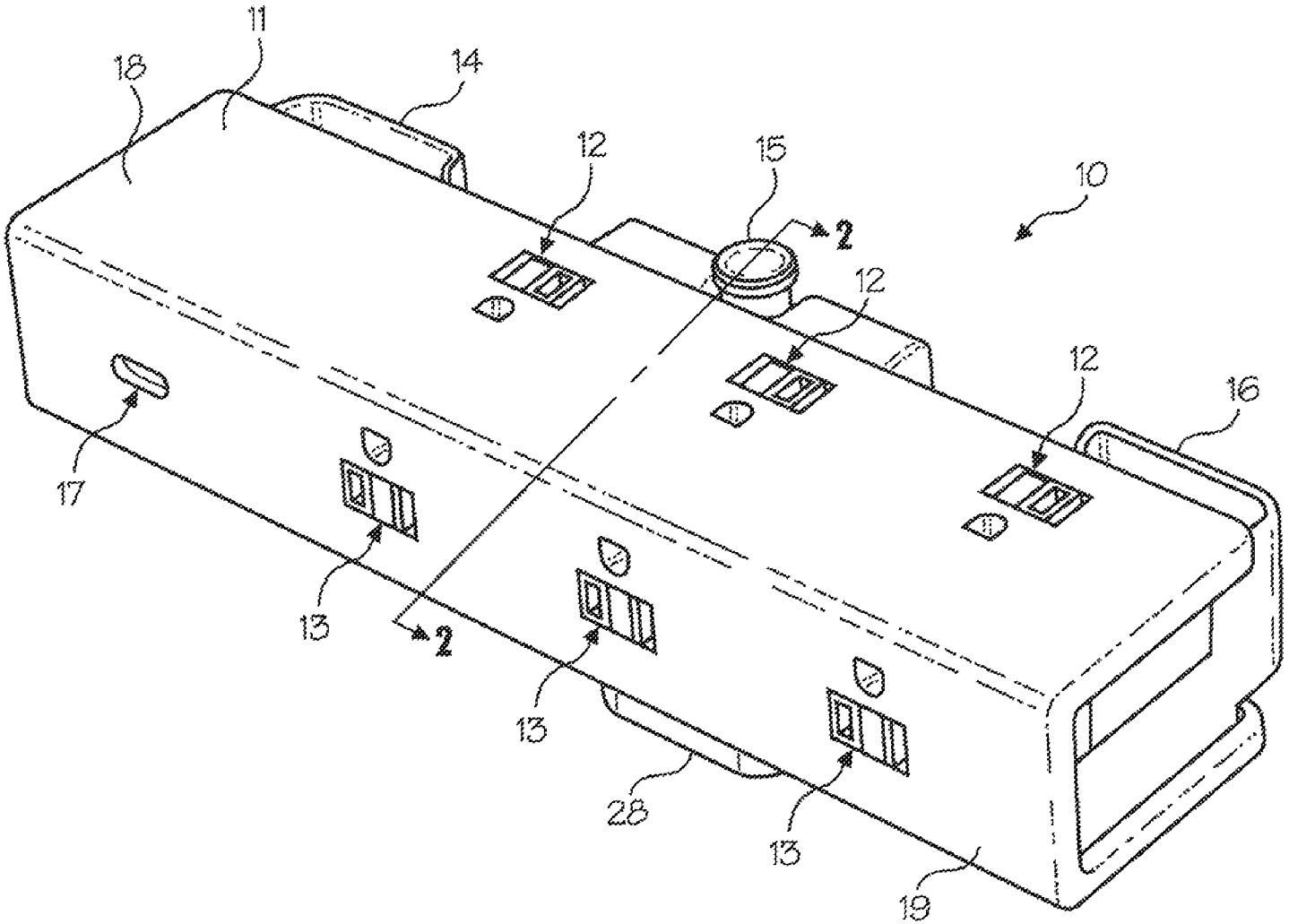
FIG. 1 is an isometric view of a power strip in accordance with an embodiment of the invention, showing the top, front, and right side of this particular embodiment.

The drawings illustrate, among other things, a particular examples of embodiments of the invention, and various examples of characteristics thereof. Different embodiments of the invention include various combinations of elements shown in the drawings, described herein, known in the art, or a combination thereof.

DETAILED DESCRIPTION OF EXAMPLES OF EMBODIMENTS

FIG. 1 shows a power strip 10 that is an example of an electronic device that is configured to attach to and be mounted on an edge of a desk, table, or board, for example. Other examples of electronic devices that may be configured to attach to and be mounted on such an edge include lamps, data communication hubs, such as universal serial bus (USB) hubs, computers, docking stations, displays, monitors, radios, televisions, chargers, audio players, video players, recording devices such as MP3 players, electronic storage devices, clocks, electric pencil sharpeners, electric erasers, remote control devices, phones, alarms, indicators, wireless routers, networking devices, servers, and the like. Other items that may be attached to (e.g., besides edges of desks, tables, and boards), include (e.g., edges of) counter tops, saw horses, work benches, sofas, chairs (e.g., arms or legs of chairs), wall studs, window sills, drafting tables, coffee tables, stools, entertainment centers, shelves, etc.

In the embodiment illustrated, power strip 10 has a housing 11, which may be hollow, and may contain various electronic components (mostly not shown), such as, multiple electrical conductors. Housing 11 may be plastic, for example, and may be formed from multiple pieces which may snap together, may fit together with tabs and slots, may be held together with fasteners such as screws, may be held together with adhesive, or a combination thereof, as examples. In the embodiment illustrated, power strip 10 includes three electrical receptacles 12 on top 18 and three electrical receptacles 13 on front 19, which are examples of electronic components within housing 11. Other embodiments may have receptacles all on one surface (e.g., on top 18, front 19, or another surface), on other surfaces (e.g., left or right sides, back, or bottom, or a combination thereof), on more than two surfaces, or the like.

Receptacles 12 and 13 are U.S. standard three-prong receptacles (e.g., for 110 V, 60 Hertz alternating current), but other embodiments may have receptacles, such as those used in other countries, which may have a different shape than what is shown. Certain embodiments may have a combination of different types of receptacles. Some embodiments may also (or instead of receptacles 12, 13, or both) have USB ports, other data ports, charger ports, multiple-pin connectors, one or more docking ports for handheld electronic devices such as an MP3 player, mobile phone, or a personal digital assistant (PDA), one or more attached cords with plugs, etc. Further, power strip 10 may be installed in an orientation with top 18 up, which may be desirable in many situations, but power strip 10 can be installed in other orientations as well, and should be understood that the word "top" and other words such as "bottom", "side", "front", and "back", are used for reference purposes, and as a suggested orientation only, and is not intended to limit the orientations in which power strip 10 can be installed or used.

Power strip 10 also includes cord management features 14 and 16 which may be used to hold or organize electrical cords that may be plugged into receptacles 12, 13, or both. In the embodiment shown, power strip 10 also includes status indicator 17. In some embodiments, power strip 10 is a surge protector, an status indicator 17 indicates whether power strip 10 is able to provide surge protection, whether power strip 10 is grounded, or the like. Status indicator 17 may include one or more light emitting diodes (LEDs), for example. Other embodiments may include a display, such as a liquid crystal digital (LCD) display, or the like, which may provide the status, other information, or both. Status indicator 17 and any surge protection circuitry (e.g., MOVs, thermal cutoffs, etc.) are further examples of electronic components that may be found within housing 11 in some embodiments. FIG. 1 also shows knob 15, which may be part of an adjustable clamp which may be used to attach power strip 10 to a desk, table, or board, for example, an which will be described in more detail with reference to other figures.

Figure 2:
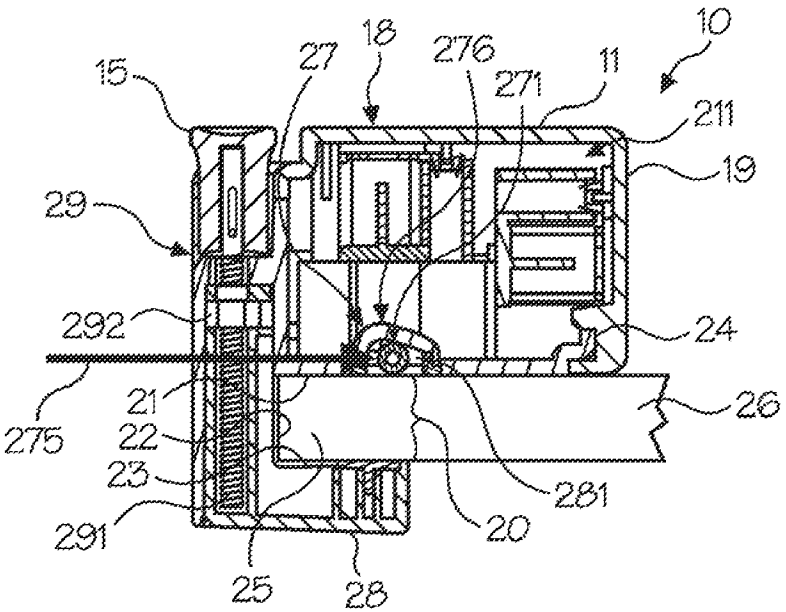
FIG. 2 is a cross-sectional side view of the power strip shown in FIG. 1, taken along section 2-2 shown in FIG. 1, showing the power strip attached to or mounted on the edge of a desk, table, or board, for example, and showing a cross section of an embodiment of a force-redirecting mechanism having a roller and a ramp.

FIG. 2 is a section view of power strip 10 taken through knob 15 (section 2-2 shown in FIG. 1). FIG. 2 illustrates that, in the embodiment illustrated, housing 11 is hollow and is made of several parts that fit together (e.g., via joint 24). In addition, housing 11 contains or houses electrical or electronic components 211, which may include surge suppressor components, electrical receptacles (e.g., 12, 13, or both), conductors, one or more switches, status indicator 17, etc.

In the embodiment illustrated, power strip 10 defines cavity, hollow area, or void 20 which is configured (e.g., shaped and defined by suitable structure) to engage edge 25 of desk, table, or board (as examples) 26. In the embodiment shown, void 20 is defined by first portion 21, second portion 22, and third portion 23, each a portion of the electronic device or power strip 10. Portions 21-23 may be surfaces of power strip 10 or housing 11 for example, which may be flat, planar, curved in one or two planes, or the like, as examples. In the embodiment shown, second portion 22 extends from first portion 21 to third portion 23, first portion 21 is opposite of third portion 23, and void 20 is between first portion 21 and third portion 23. In a number of embodiments, portion 21 and portion 23 are parallel (e.g., as viewed in FIG. 2, or define substantially parallel planes).

Figure 3:
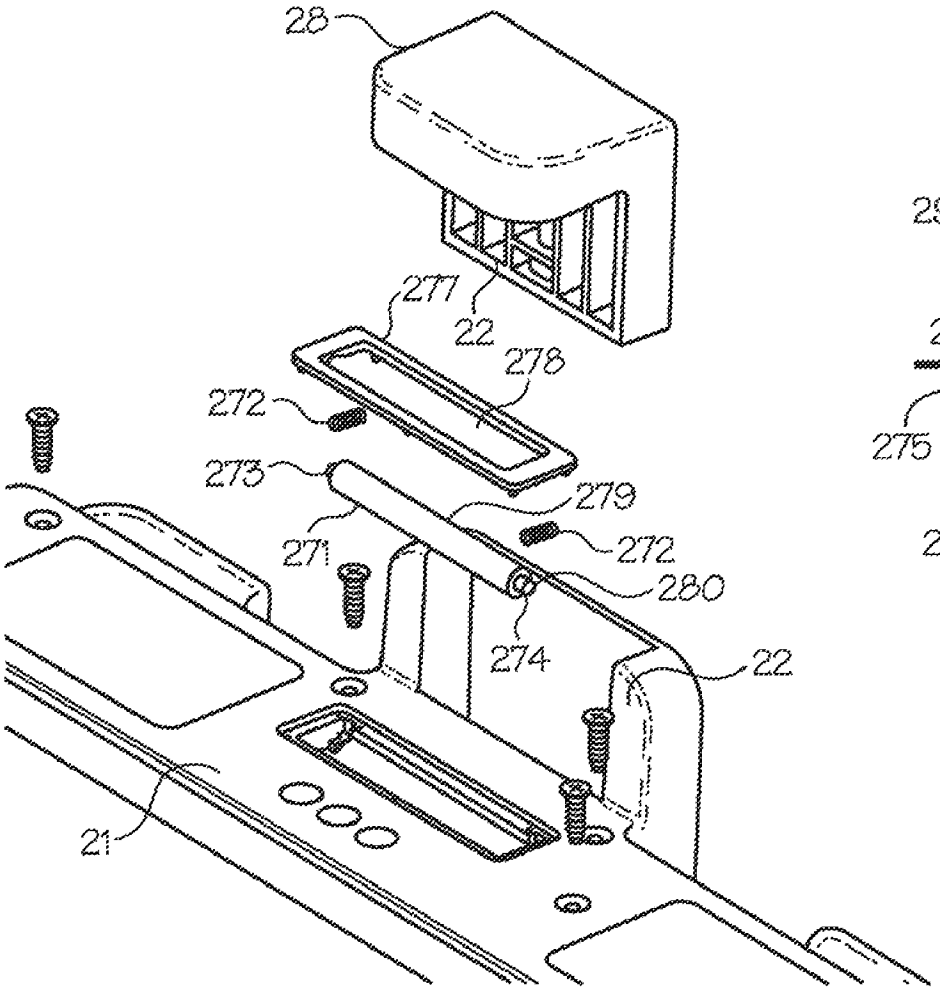
FIG. 3 is an exploded isometric view of part of the power strip of FIGS. 1 and 2, showing part of the bottom side of this particular embodiment, and showing the roller.

In the embodiment illustrated, power strip 10, within first portion 21, includes first force-redirecting mechanism 27. In other embodiments, a force-redirecting mechanism may be provided within third portion 23 (in addition or instead). In the embodiment shown, force-redirecting mechanism 27 includes roller 271 and, as shown in FIG. 3, helical springs 272. Roller 271 is an example of a first moving part (e.g., of force redirecting mechanism 27) and springs 272 are an example of a first biasing element configured to bias the first moving part (e.g., roller 271) into contact with edge 25 of the desk, table, or board, (for example) 26, when edge 26 is in void 20, for instance. As used herein, "biasing" means to move or exert a force (e.g., push or pull). Other embodiments may have other biasing elements such as springs of other shapes, air springs, elastomeric materials, magnets, weights, or the like. Also, as used herein, springs 272 bias the first moving part (e.g., roller 271) away from power strip 10 and away from housing 11. In other embodiments, a moving part of a force redirecting mechanism may be biased away from an arm or jaw (e.g., 28), as other examples.

In the embodiment shown, springs 272 exert spring force 275 (as shown in FIG. 2) on ends 273 and 274 of roller 271. In this embodiment, mechanism 27 also includes ramp 276 and cover 277. Springs 272 bias roller 271 in the direction of spring force 275 such that roller 271 pushes against ramp 276 and out (down) through opening 278 into void 20, away from power strip 10 and housing 11, and against edge 25 of the desk, table, or board (for example) 26. If edge 25 of the desk, table, or board (for example) 26 is not within void 20, or is not close enough to portion 21, then ends 273 and 274 (shown in FIG. 3) of roller 271 contact cover 277 of force-redirecting mechanism 27, preventing roller 271 from falling out of force-redirecting mechanism 27 into void 20. Cover 277 may attach to housing 11 via a snap fit, an adhesive, fasteners, or the like, as examples.

Figure 4:
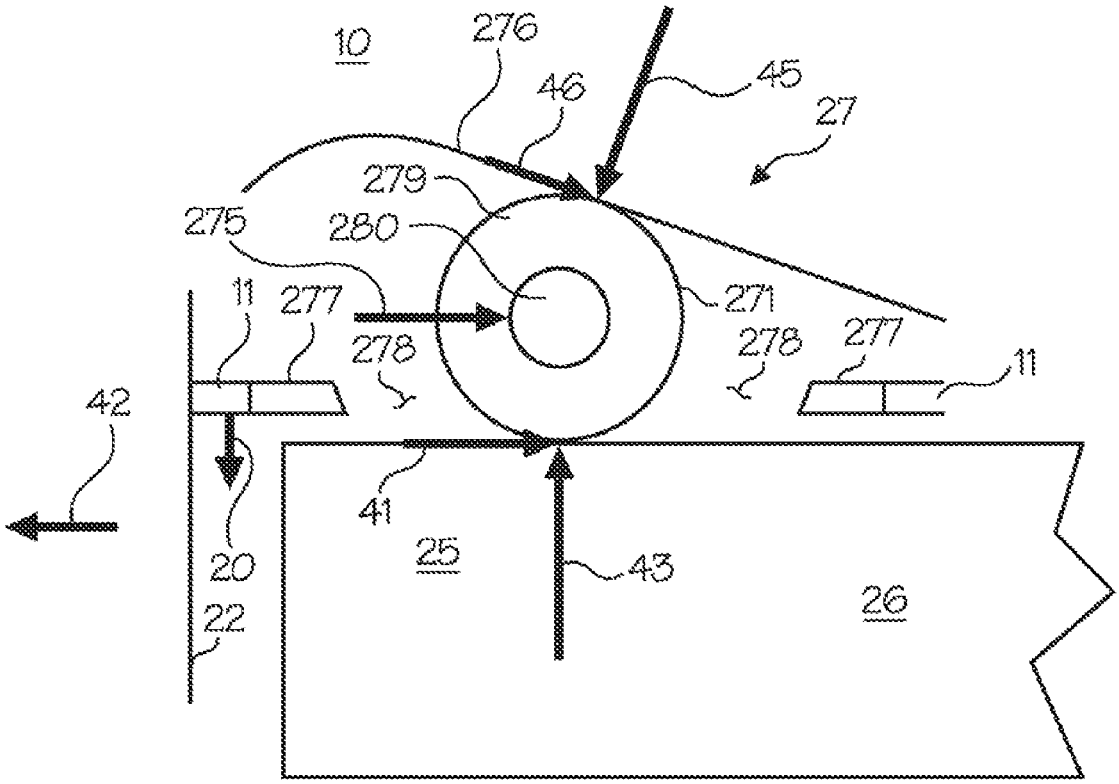
FIG. 4 is a close partial cross-sectional side view of the roller of FIG. 2 showing, among other things, examples of forces that may be applied to the roller.

In the embodiment shown, the first moving part or roller 271 rolls on ramp 276, which is an inclined surface, and may be inclined relative to first portion 21, third portion 23, edge 25, part of jaw or arm 28, part of housing 11, or a combination thereof, as examples. In the embodiment illustrated, ramp 276 is also inclined relative to spring force 275, as shown. As shown in FIGS. 3 and 4, in the embodiment shown, roller 271 comprises exterior 279, which may be made of a tubular piece of material, which may be an elastomeric material, for example. Exterior 279 may surround (as shown) inner pin 280, which may be round or cylindrical, as shown. In a number of embodiments, pin 280 has a substantially higher modulus of elasticity than exterior 279. As used herein, a substantially higher modules of elasticity means greater than ten (10) times higher. Exterior 279 may attach to pin 280 with an adhesive or an interference fit, as examples, or a clearance fit may exist between exterior 279 and pin 280, for instance.

In the embodiment depicted, pin 280 extends beyond exterior 279 on each end 273 and 274 of roller 271, and each end (e.g., 273 and 274) of pin 280 is contained within space 281 defined or bordered on two sides by ramp 276 and cover 277. In this embodiment, as used herein, space 281 is a substantially triangular space in housing 11. As used herein, substantially triangular, means triangular, except that corners of the triangle may be rounded or cut off. In other embodiments, ends 273 and 274 may be contained within slots or other shape spaces. In the embodiment shown, the first biasing element comprises the two helical springs 272 which press against two ends 273 and 274 of pin 280, biasing roller 271 against inclined surface or ramp 276 and into void 20 through opening 278 in cover 277, away from power strip 10 and housing 11.

In a number of embodiments, the first moving part and first force-redirecting mechanism are configured such that a first frictional force acting between the edge and the first moving part, when the electronic device is biased in a direction away from the edge, (e.g., in a direction such that the second portion 22 of the electronic device or power strip 10 is biased away from edge 25), causes the first moving part to bias toward edge 25, thereby increasing the clamping force between the first moving part and edge 25, and thereby increasing the first frictional force acting between edge 25 and the first moving part. This redirection of forces may act to resist the removal of the electronic device or power strip (e.g., 10) from edge 25 of the desk, table, or board, for example, 26. FIG. 4 illustrates an example of this, and shows a more-detailed view (in some aspects) of part of the embodiment shown in FIG. 2.

Specifically, in FIG. 4, spring force 275 (e.g., from springs 272 shown in FIG. 3), causes the first moving part (e.g., roller 271) to move or bias in the direction of spring force 275 (e.g., horizontally to the right). Roller 271 is in contact with, or comes into contact with ramp 276, and then moves or biases parallel to ramp 276, resulting in a component of motion or force in the downward direction (downward in the orientation illustrated) such that the first moving part (e.g., roller 271) contacts edge 25 of desk, table, or board (for example) 26, located within void 20. Roller 271 extends or projects through opening 278 (shown in FIG. 3) in cover 277. This results in normal or clamping force 43 exerted by edge 25 on roller 271. (As used herein, a "normal" force, or component of a force, is applied at a right angle to the surface to which the force is applied.) On roller 271, clamping force 43 may be balanced (e.g., in static equilibrium) by force 45 between ramp 276 and roller 271 (in a direction normal to ramp 276) and spring force 275. If power strip 10 is pushed or pulled in direction 42, such that the second portion 22 of the electronic device or power strip 10 moves or is biased away from edge 25 of the desk, table or board (for example) 26, for instance, then first frictional force 41 is exerted by edge 25 on roller 271. First frictional force 41 may be balanced, in static equilibrium, with frictional force 46 exerted on roller 271 by ramp 276.

In the embodiment shown, first frictional force 41 is in the same direction as spring force 275 and tends to cause roller 271 to roll along ramp 276 (e.g., relative to power strip 10) in the direction of forces 41 and 271. This force 41 and motion causes roller 271 to bias or tend to move along ramp 276 toward edge 25 (e.g., downward), resulting in an increased clamping force 43 and normal ramp force 45. The increases in these normal forces (e.g., 43 and 45) result in an increase in the potential frictional forces 41 and 46 (e.g., an increase in the force at which sliding would occur). Thus, the greater force 42 becomes, the greater also will normal or clamping force 43 and frictional force 41 become.

In the embodiment illustrated, roller 271, which is an example of the first moving part, and first force-redirecting mechanism 27, including ramp 276, are configured, in this example, such that first frictional force 41 acts between edge 25 (of desk, table, or board, for example, 26) and first moving part or roller 271, when the electronic device (e.g., power strip 10) is biased in direction 42 away from edge 25. The biasing of power strip 10 in direction 42 (e.g., relative to edge 25), and the contact between roller 271 and edge 25, results in frictional force 41, which is in an opposite direction to direction 42. Force-redirecting mechanism 271, including roller 271 and ramp 276, is configured such that frictional force 41, when force 42 is applied, causes roller 271 to bias toward edge 25, thereby increasing clamping force 43 between roller 271 and edge 25, and thereby increasing the (e.g., maximum potential) first frictional force 41 acting between edge 25 and roller 271. This redirection of forces may act to resist the removal of power strip 10 from edge 25 of the desk, table, or board (for example) 26.

In many instances, force 43 (shown in FIG. 3) on edge 25 may be balanced, or in static equilibrium, with another force between portion 23 (e.g., shown in FIG. 2), and edge 25 (e.g., on the bottom side of edge 25, in the orientation shown). This other force between portion 23 and edge 25 may also have both normal and tangential or frictional components, and the frictional component may also help to counteract force 42 acting to separate power strip 10 from edge 25, depending on where force 42 is applied. As shown in FIG. 2, portion 23 in the embodiment illustrated, is formed by jaw 28. Jaw 28 is an example of an arm that extends or projects from the electronic device, power strip (e.g., 10), or housing (e.g., housing 11). In this embodiment, arm or jaw 28 forms the third portion 23 of power strip 10 or housing 11, but in other embodiments a jaw or arm may form the first portion 21 of power strip 10 or housing 11, instead or in addition. In this embodiment, arm or jaw 28 also forms the second portion 22 of power strip 10, while housing 11 forms the first portion 21.

In the embodiment shown (e.g., in FIG. 2), power strip 10 also includes adjustable clamp 29 that includes a first member 291 that is threaded with external helical threads, second member 292 that is threaded with internal helical threads that are configured to mate with the external helical threads of first member 291, and rotatable knob 15 for adjusting clamp 29. Adjustable clamp 29 moves jaw (or arm) 28, or jaw or arm 28 may be considered part of clamp 29. In this embodiment, knob 15 is attached to first member 291, for example, with a pin or adhesive, for instance, or knob 15 may be formed or molded over splines, threads, or other features on member 291, or in still other embodiments, knob 15 and member 291 may be combined into one part. In various embodiments, first member 291 may be a bolt or a piece of threaded rod, as examples, and second member 292 may be a nut or a component with an internally threaded hole, for instance. An operator may turn knob 15 with his or her fingers, for instance, to move jaw or arm 28 (e.g., in the vertical direction, in the orientation shown in FIG. 2). Clamp 29 may be adjusted to accommodate differing thicknesses (e.g., in the vertical direction, in the orientation shown in FIG. 2) of desk, table, or board (for example) 26, to change the thickness of void 20, to change the distance between portions 21 and 23, to change the size of portion 22, to apply a clamping force (e.g., parallel to and in addition to or instead of force 43 shown in FIG. 4), or a combination thereof, as examples.

In some embodiments, a knob (e.g., knob 15) may extend or be pulled up so that an operator can get a better grip on the knob when turning the knob. In such embodiments, the knob (e.g., knob 15) may be pushed down to get the knob out of the way when not being used (e.g., turned), for example. In particular embodiments, a pin extends through the knob (e.g., knob 15) and through a slot in member 291. In other embodiments, member 291 may have a cross-section within the knob (e.g., 15) that is not round, for example, that is square, rectangular, pentagonal, hexagonal, octagonal, triangular, polygonal (e.g., that has a cross-section that is a regular polygon), splined, star shaped, that has at least one keyway, that has at least one flat or concave side, etc. Furthermore, in some embodiments, the diameter of the knob (e.g., 15) is kept small (e.g., selected) to reduce the amount of torque that an operator can apply by hand. In certain embodiments, a slipping clutch or other torque-limiting mechanism is used to limit the amount of torque that can be applied (e.g., to member 291). In some such embodiments, a known amount of clamping force is applied each time the clamp is tightened (e.g., by different operators) to provide consistent and repeatable results.

Figure 5:
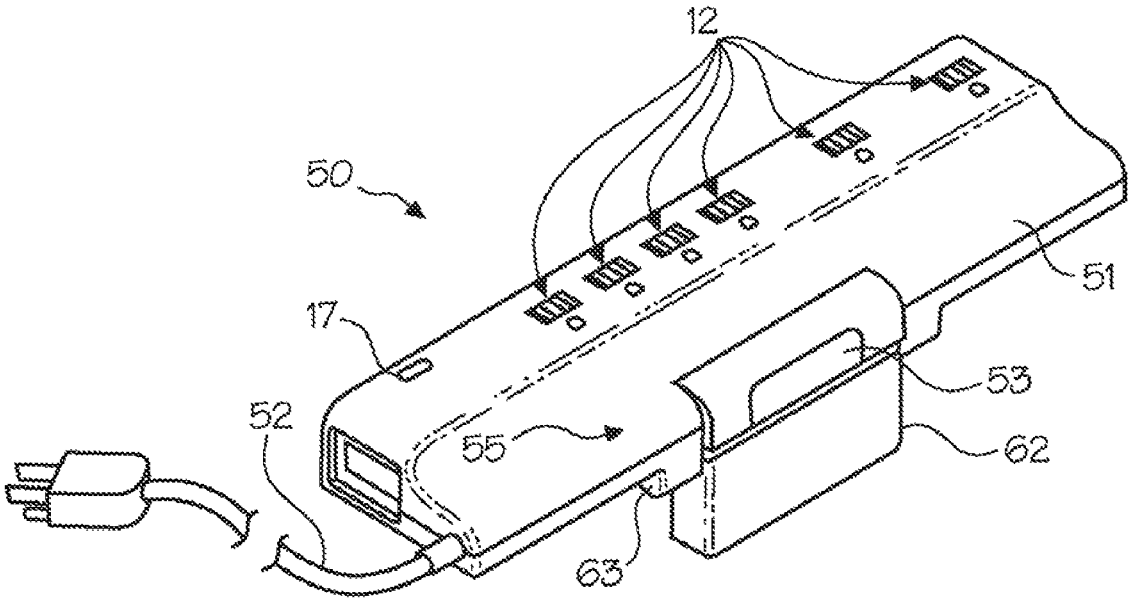
FIG. 5 is an isometric view of another embodiment of a power strip in accordance with the invention, showing the top, back, and right side of this particular embodiment, and showing an arm with a pivot mount.

Turning now to another example of an embodiment, FIGS. 5-9 show a power strip 50 that is another example of an electronic device that is configured to attach to and be mounted on an edge (e.g., 25) of a desk, table, or board, for example (e.g., 26). As shown in FIG. 5, power strip 50 includes multiple electrical power receptacles 12, for example, and has a status indicator 17, which may be as described above for power strip 10, although some embodiments may omit a status indicator or may have different types, arrangement or positioning of receptacles, ports, or the like, or a combination thereof. In the embodiment shown, some of the receptacles 12 of power strip 50 are close together while others are spaced apart to allow extra room for large plugs, transformers, power supplies, direct plug-in devices (e.g., without power cords) or the like. In many embodiments, electronic devices such as power strips (e.g., 10 or 50) may include one or more on/off switches, such as rocker switches, push buttons, or the like, which may perform functions such as turning on and off various combinations of some or all of the electrical receptacles (e.g., 12, 13, or both), for instance. In some embodiments, such switches may be remotely activated, controlled by a timer, controlled by a computer, etc., or may be manual, lighted, or the like, as other examples.

Figure 7:
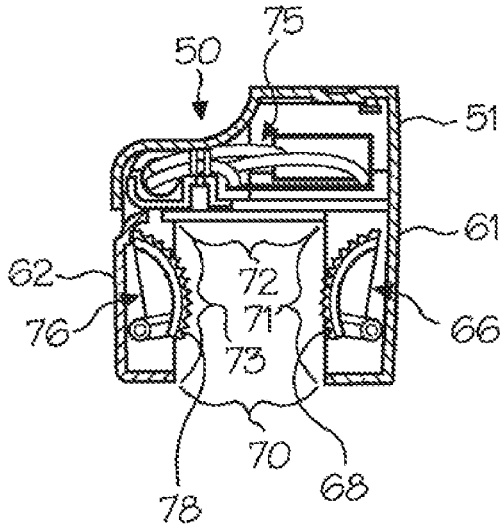
FIG. 7 is a cross-sectional side view of the power strip of FIGS. 5 and 6, time taken through two of the cams of the force-redirecting mechanisms, and showing, among other things, cams that are fully or nearly fully retracted, and a void formed by three portions of the power strip.
Figure 8:
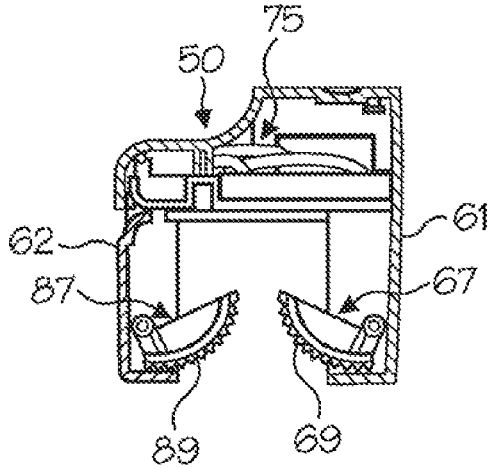
FIG. 8 is another cross-sectional side view of the power strip of FIGS. 5 and 6, this time taken through two of the cams of the other force-redirecting mechanisms, and showing, among other things, cams that are fully or nearly fully extended.
Figure 9:
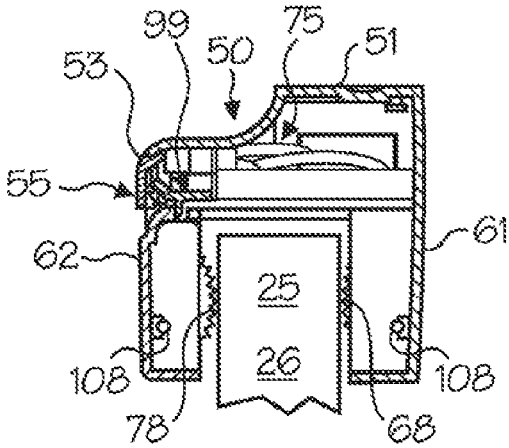
FIG. 9 is yet another cross-sectional side view of the power strip of FIGS. 5 and 6, taken through a midpoint of the power strip, and showing, among other things, the power strip attached to or mounted onto an edge of a desk, table, or board, for example.

Power strip 50 also includes housing 51, which may be similar to housing 11 described above, except where differences are apparent, such as differences in shape. Housing 51 may contain various or multiple components, such as electronic components 75, for example, which may be similar to electrical components 211 described above, for instance. Power strip 50 also includes power cord 52, which contains several electrical wires or conductors. Power cord 52, in this embodiment, is both physically (i.e., structurally) and electrically attached to power strip 50. Receptacles 12 and a portion of power cord 52 are examples of electronic components (e.g., 75) housed within housing 51. (Although not shown, power strip 10 may also have a power cord similar to power cord 52.) FIGS. 7-9 show electronic components 75 within housing 51, which may include wires or electrical conductors (e.g., part of power cord 52), surge suppressor components, etc.

As shown in FIGS. 6-9, in this embodiment, power strip 50 includes first arm 61 and second arm 62 projecting from housing 51. In this embodiment, first arm 61 is fixed relative to power strip 50 and housing 51. In fact, arm 61 may be part of housing 51, formed of the same piece of material, or integral therewith. As used herein, "fixed" means not moving (excepting minor deflection as a result of strain resulting from applied stresses, for example). In contrast, in this embodiment, second arm 62 pivots at pivot mount 63, for example, about a pin or projection from arm 62, into arm 62, or the like, for instance. As shown in FIGS. 5 and 9, release mechanism 55 holds second arm 62 in the position shown in FIGS. 5-9 (e.g., parallel or substantially parallel to first arm 61), unless button 53 is pressed, moving release pawl 99 and releasing second arm 62 to pivot about pivot mounts 63 away from (and out of parallel with) first arm 61. In this embodiment, second arm 62 stays out of parallel with first arm 61 until second arm 62 is returned to the position shown in FIGS. 5-9, engaging release pawl 99 and release mechanism 55.

As used herein, "parallel" means to within one degree, and "substantially parallel" means to within 5 degrees. In some embodiments, arms, such as arms 61 and 62, (or jaw or arm 28 described above, in comparison to portion 21 of housing 11, as another example) may be angled slightly toward each other, when in a relaxed state, so that strain or deformation caused by clamping forces (e.g., 43) results in the arms (or arm and hosing) being parallel or substantially parallel. In some embodiments, a spring may move arm 62 into the position shown in FIGS. 6-9, for instance, automatically reengaging release mechanism 55 after power strip 50 is removed from edge 25 of desk, table, or board (for example) 26. Furthermore, in some embodiments, instead of release mechanism 55 and pivot mounts 63, an adjustable clamp may be provided (e.g., similar to clamp 29 described above), or both arms 61 and 62 may be fixed and a trigger mechanism may be provided to retract the moving parts or disengage the force redirecting mechanism(s).

As shown in FIG. 7, in the embodiment illustrated, power strip 50 defines cavity, hollow area, or void 70 which is configured (e.g., shaped and defined by suitable structure) to engage edge 25 of desk, table, or board (as examples) 26. In the embodiment shown, void 70 is defined by first portion 71 of first arm 61, second portion 72 of housing 51, and third portion 73 of second arm 62, each of the electronic device or power strip 50. In this embodiment, first arm 61 forms first portion 71 and second arm 62 forms third portion 73. Void 70 may be similar to void 20 described above, and portions 71-73 may be similar to portions 21-23 described above, except where differences are apparent. In the embodiment shown, second portion 72 extends from first portion 71 to third portion 73, first portion 71 is opposite of third portion 73, and void 70 is between first portion 71 and third portion 73. In a number of embodiments, portions 71 and 73 are parallel or substantially parallel (e.g., as viewed in FIG. 7). Although only labeled with reference numbers in FIG. 7, it should be understood that void 70 and portions 71-73 are present in FIGS. 5, 6, 8, and 9 as well, FIG. 9 shows edge 25 of desk, table, or board (for example) 26 inserted into void 70 of power strip 50.

Figure 6:
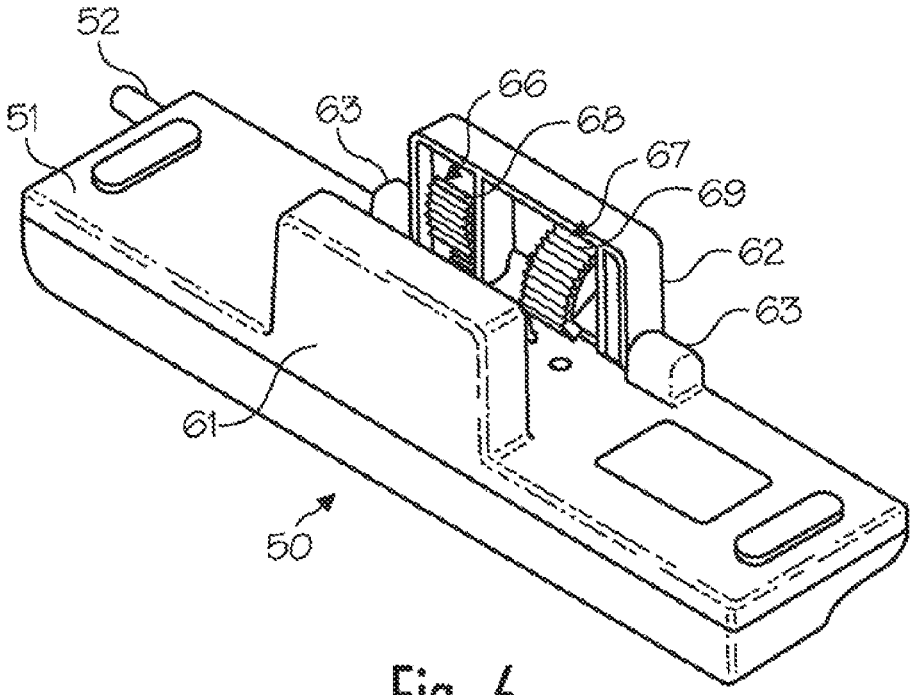
FIG. 6 is another isometric view of the embodiment of power strip of FIG. 5, showing the bottom, front, and right side of this specific embodiment, and showing two arms and force-redirecting mechanisms that include cams.
Figure 10:
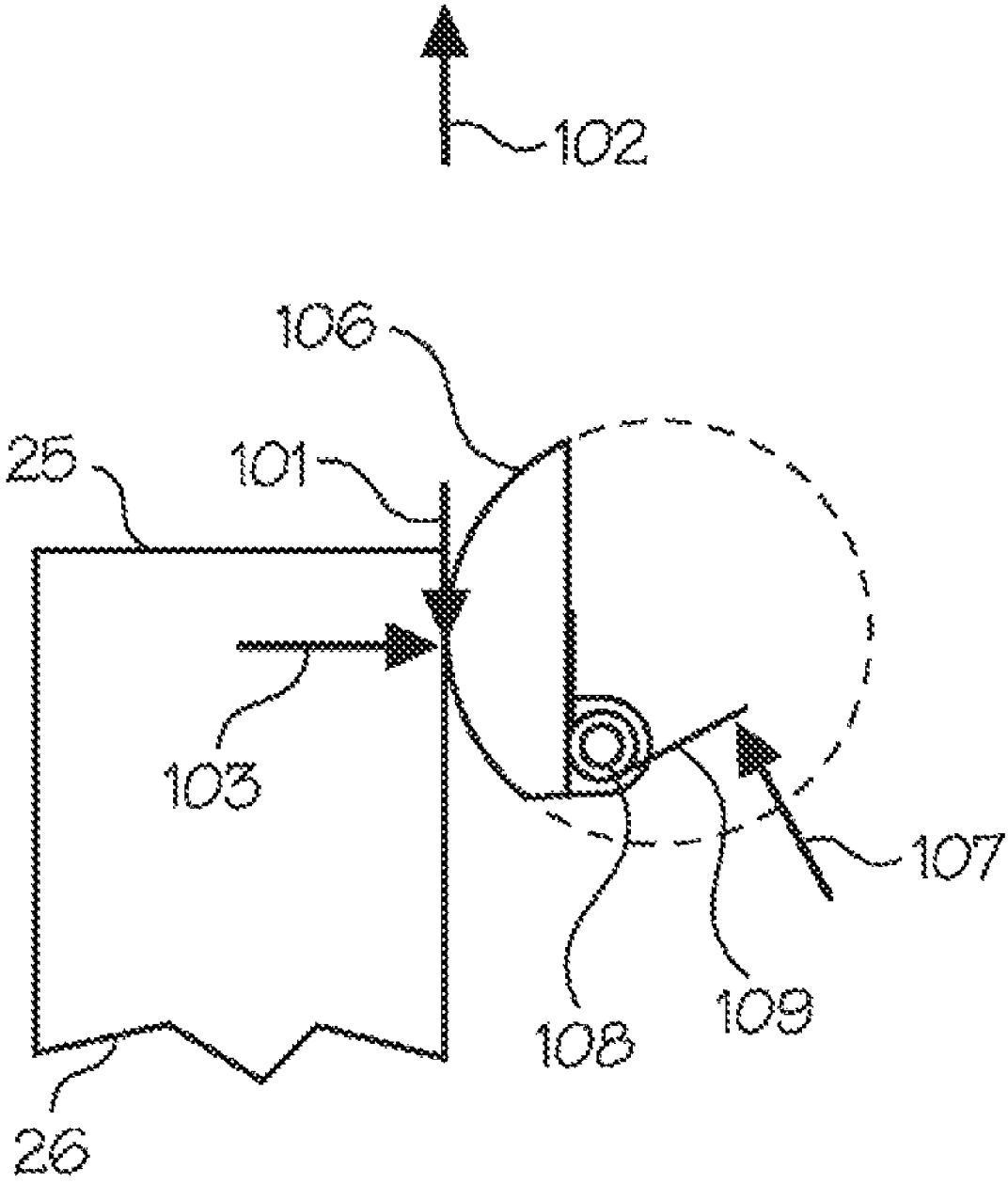
FIG. 10 is a close side view of a force-redirecting mechanism, for instance, of the particular embodiment shown in FIGS. 5-9, showing, among other things, the spring, the shape of the cam, and forces that may be applied to the cam and spring, including forces applied by the edge of the desk, table or board, for example.

In the embodiment shown, power strip 50 includes force-redirecting mechanisms 66, 67, 76, and 87 as shown in FIGS. 6, 7, and 8 (for example), which include cams 68, 69, 78, and 89. In this embodiment, each force-redirecting mechanism (e.g., 66, 67, 76, and 87) includes a spring 109, as shown in FIG. 10, and a pin 108. Spring 109 biases the cam (e.g., 68, 69, 78, or 89, or cam 106) into void 70 and (if present) against edge 25 of desk, table, or board (for example) 26. Moreover, in this embodiment, the moving parts or cams (e.g., 68, 69, 78, or 89, or cam 106) have a limited range of motion. Specifically, motion of the cam (e.g., cam 106 shown in FIG. 10) is limited to rotation about pin 108, for a certain arc or angle of rotation. This angle of rotation may be, about 90 degrees, 90 degrees, or slightly more than 90 degrees, as examples. This angle of rotation may be, for instance, 75, 80, 85, 90, 95, 100, 105, 110, 115, 120, 125, 130, or 135 degrees, as examples.

In this embodiment, the force-redirecting mechanisms (e.g., 66, 67, 76, and 87) are shown in the arms (e.g., first and second arm 61 and 62), but in other embodiments, some or all of the force-redirecting mechanisms may be located elsewhere within or on the electronic device or power strip, such as within or on the housing or in the body of the device (e.g., similar to force-redirecting mechanism 27 shown in FIG. 2).

Cam 106 shown in FIG. 10 is an example of cams 68, 69, 78, and 89 shown in FIGS. 6-9, and FIG. 10 shows an example of a shape of cam 106, and an example of scale. In this embodiment, cams 68, 69, 78, and 89 all have the same size and shape (e.g., of cam 106). In other embodiments, cams (e.g., 68, 69, 78, or 89, or cam 106) may have different dimensions, a different shape, or both. As illustrated by the dashed circle in FIG. 10, in some embodiments, cam 106 has a cam surface that is the shape of part of a circle or eccentric, but in other embodiments, cams (e.g., 68, 69, 78, and 89) may have surface that is shaped like part of a spiral, for instance. In the embodiment illustrated in FIG. 10, cam 106 rotates about pin 108, which has a centerline that is offset from the centerline of the dashed circle that forms the face of cam 106. For example, in some embodiments, the face of cam 106 and the dashed circle shown in FIG. 10, have a radius of 18 mm, and (in the orientation of FIG. 10) the centerline of pin 108 is 9.5 mm below and 4.75 mm to the left of the centerline of the dashed circle. Other embodiments may have other dimensions or relative dimensions.

As shown in FIGS. 6-9, cams 68, 69, 78, and 89 may have teeth in some embodiments. On the other hand, cam 106 is shown without teeth, and illustrates that some embodiments of cams (e.g., 106) may omit teeth. In some embodiments, the surface of the cams (e.g., 68, 69, 78, and 89) may be made of an elastomer, closed-cell foam, synthetic rubber, or the like, which (like exterior 279 of roller 271 described above) may spread forces over a larger area, reduce the potential to damage edge 25 of desk, table, or board (for example) 26, provide a greater coefficient of friction between the cam and edge 25, avoid scratching or marring edge 25, absorb or dampen vibration, or a combination thereof, as examples.

As shown, power strip 50 has four cams (e.g., 68, 69, 78, and 89), two each on portions 71 and 73 on (first and second) arms 61 and 62, each cam acting independently. These cams (e.g., 68, 69, 78, and 89) may be referred to as the first through fourth cams, for example, and the force-redirecting mechanisms (e.g., 66, 67, 76, and 87) may be referred to as the first through fourth force-redirecting mechanisms, for instance. Other embodiments may have fewer or more force-redirecting mechanisms or cams (e.g., 1, 2, 3, 5, 6, 7, 8, 9, 10, or 12 etc., force-redirecting mechanisms or cams), cams may work together, (e.g., on a common shaft or axis) or there may be one, two, or more cams just on one of portions 71 and 73 (e.g., one of arms 61 and 62), for instance. Particular embodiments include (at least) two cams (e.g., within first portion 71 of electronic device or power strip 50, or first arm 61) and a second arm (e.g., arm 62) projecting from the housing (e.g., 51), such that the second arm (e.g., arm 62) forms third portion 73 of electronic device or power strip 50, and the second arm (e.g., arm 62) in such an embodiment may include the pivot mount (e.g., 63). In some embodiments, there may be an unequal number of cams on opposing surfaces or sides, for example, two cams on one portion (e.g., 71) and one cam on the other (e.g., portion 73, or vice versa).

In FIGS. 6, 7, and 9, cams 68 and 78 are shown fully (or nearly fully) retracted, whereas in FIGS. 6 and 8, cams 69 and 89 are shown fully (or nearly fully) extended. In actual use, the cams (e.g., 68, 69, 78, and 89) would usually be in essentially the same position at the same time. For example, the cams (e.g., 68, 69, 78, and 89) would be fully extended when edge 25 of desk, table, or board (for example) 26 is not within void 70, but may all be partially or nearly fully retracted when edge 25 is within void 70 (e.g., as shown in FIG. 9). The cams (e.g., 68, 69, 78, and 89) would not be retracted as far (i.e., would be extended more) if edge 25 of desk, table, or board (for example) 26, were thinner. Thus, power strip 50 can attach to or be mounted on edge 25 of desk, table, or board (for example) 26, having differing thicknesses, within a range of thicknesses. This range of thicknesses may be, for example, from about ¾ inch to about 1½ inches. In other embodiments, this range may be from ¼ inch to 2 inches, from ½ inch to 1½ inches, from ½ inch to 1¾ inches, from ¾ inches to 1⅝ inches, from ¾ inches to 1¾ inches, from ⅜ inches to 1⅞ inches, or the like, as examples. In some cases, power strip 50 may be attached to or mounted on an object having a different thickness in different locations, and the cams (e.g., 68, 69, 78, and 89) may be extended different amounts to accommodate the differing thickness.

In the embodiment shown, the cams (e.g., 68, 69, 78, and 89) are examples of moving parts (e.g., of force-redirecting mechanisms 66, 67, 76, and 87), and springs 109 are examples of biasing elements configured to bias the moving parts (e.g., cams 68, 69, 78, and 89) into the void 70, away from arms 61 and 62, and into contact with edge 25 of desk, table, or board (for example) 26 when edge 25 is within void 70, as shown in FIG. 9, for example. Referring to FIG. 10, in the embodiment of power strip 50, these moving parts (e.g., cams 68, 69, 78, and 89) and force-redirecting mechanisms (e.g., 66, 67, 76, and 87), are configured such that frictional force 101 acting between edge 25 and the moving part or cam 106, tends to hold power strip 50 on edge 25.

Specifically, spring 109 pushes or biases cam 106 against edge 25, resulting in normal or clamping force 103 shown in FIG. 10. Spring 109 reacts or pushes against force 107, which is applied, for example, by or against part of housing 51 or arm 61 or 62, for example. When the electronic device (e.g., power strip 50) is biased in the direction of force 102 away from edge 25 (e.g., such that the second portion 72 of the electronic device, as shown in FIG. 9, biases in a direction away from edge 25), frictional force 101 causes the moving part (e.g., cam 68, 69, 78, 89, or 106) to bias in rotation about pin 108 toward edge 25. This increases clamping force 103 between the moving part (e.g., cam 68, 69, 78, 89, or 106) and edge 25, and thereby increases the maximum possible or potential frictional force 101 acting between edge 25 and the moving part (e.g., cam 68, 69, 78, 89, or 106). Thus, frictional force 101 further resists the removal of the electronic device (e.g., power strip 50) from edge 25 of desk, table, or board (for example) 26. Thus, the greater force 102 becomes, the greater clamping force 103, and thus, frictional force 101, become. In other words, cam 106, and the mechanism thereof, redirects force 102 acting on power strip 50 in the direction shown, into a clamping force 103 acting to clamp power strip 50 onto edge 25, resulting in sufficient frictional force 101, for example, to overcome force 102.

In the embodiment illustrated, power strip 50 easily slips onto edge 25 of desk, table, or board (for example) 26 when first and second arms 61 and 62 are parallel and release mechanism 55 is engaged. When a user wishes to remove power strip 50 from edge 25 of desk, table, or board (for example) 26, the user presses release button 53, releasing release mechanism 55, second arm 62 swings away from first arm 61, and at least some of the cams (e.g., cams 68, 69, 78, and 89) move out of contact with edge 25, and power strip 50 can easily be removed from edge 25 of desk, table, or board (for example) 26. In other embodiments, a trigger mechanism may be provided to retract some or all of the cams (e.g., cams 68, 69, 78, and 89) so that they move out of contact with edge 25, and power strip 50 can then easily be removed from edge 25 of desk, table, or board (for example) 26.

As shown, for example, in FIGS. 1, 5, and 6, in a number of embodiments, arms (e.g., jaw 28, arm 61, arm 62, or both arms 61 and 62) are located at or near (e.g., straddling) the middle of the power strip (e.g., 10 or 50), for instance, in the direction of the longest dimension (or in a direction parallel to the longest side) of the power strip. Further, in a number of embodiments, the overall dimension of the arm or arms (e.g., jaw 28, and arms 61 and 62) in a direction that is parallel to the longest side of the electronic device or power strip (e.g., 10 or 50) is less than half of the overall dimension of the longest side of the electronic device or power strip (e.g., 10 or 50). In fact, in the embodiments illustrated, the overall dimension of the arm or arms (e.g., jaw 28, and arms 61 and 62) in a direction that is parallel to the longest side of the electronic device or power strip (e.g., 10 or 50) is equal to or less than one third of the overall dimension of the longest side of the electronic device or power strip (e.g., 10 or 50). In other embodiments, this dimension of the arm or arms may be longer or shorter, but the relative dimensions illustrated provide certain advantages in certain circumstances, for example, providing adequate support, while reducing or minimizing the amount of desk, table, or board (for example) 26 that is occupied by the electronic device or power strip (e.g., 10 or 50).

Various embodiments of the invention include various combinations of the features described herein or shown in the drawings. The invention also contemplates various procedures or methods of providing or obtaining different combinations of the components or structure described herein. Such procedures may include acts such as providing various structural components described herein, and providing components that perform functions described herein, as well as packaging, advertising, and selling products such as electronic devices (e.g., power strips or surge protectors) described herein, for instance, through retail stores or over the Internet. The invention also contemplates various means for accomplishing the various functions described herein or apparent from the structure described.

What is claimed is:

1. An electronic device configured to attach to and be mounted on an edge of a desk, table, or board, the electronic device comprising:

a housing containing electronic components including multiple electrical conductors;

a void configured to engage the edge of the desk, table, or board, wherein the void is defined by a first portion of the electronic device, a second portion of the electronic device, and a third portion of the electronic device, wherein the second portion extends from the first portion to the third portion, the first portion is opposite of the third portion, and the void is between the first portion and the third portion;

wherein at least one of the first portion or the third portion includes at least a first force-redirecting mechanism comprising at least a first moving part and a first biasing element configured to bias the first moving part into contact with the edge of the desk, table, or board, when the edge is in the void, wherein the first moving part and first force-redirecting mechanism are configured such that a first frictional force acting between the edge and the first moving part, when the electronic device is biased in a direction away from the edge, in a direction such that the second portion of the electronic device is biased away from the edge, causes the first moving part to bias toward the edge, thereby increasing a clamping force between the first moving part and the edge, and thereby increasing the first frictional force acting between the edge and the first moving part, and thereby resisting the removal of the electronic device from the edge of the desk, table, or board.

2. The electronic device of claim 1 further comprising at least a first arm projecting from the housing, wherein the first arm forms the first portion of the electronic device.

3. The electronic device of claim 2 further comprising a second arm projecting from the housing, wherein the second arm forms the third portion of the electronic device, and wherein the first force-redirecting mechanism is located in the first arm.

4. The electronic device of claim 1 wherein at least one of the first portion or the third portion includes a second force-redirecting mechanism comprising at least a second moving part and a second biasing element configured to bias the second moving part into contact with the edge of the desk, table, or board, when the edge is in the void, wherein the second moving part and second force-redirecting mechanism are configured such that a second frictional force acting between the edge and the second moving part, when the electronic device is biased in a direction away from the edge, such that the second portion of the electronic device biases in a direction away from the edge, causes the second moving part to bias toward the edge, thereby increasing a clamping force between the second moving part and the edge, and thereby increasing the second frictional force acting between the edge and the second moving part, and thereby resisting the removal of the electronic device from the edge of the desk, table, or board.

5. The electronic device of claim 1 wherein the first moving part has a limited range of motion, wherein the electronic device comprises a pin, and wherein the pin limits the range of motion of the first moving part.

6. The electronic device of claim 1 wherein the first moving part is a first cam that rotates about an axis.

7. The electronic device of claim 6 wherein at least one of the first portion or the third portion includes at least a second force-redirecting mechanism comprising at least a second moving part and a second biasing element configured to bias the second moving part into contact with the edge of the desk, table, or board, when the edge is in the void, wherein the second moving part and second force-redirecting mechanism are configured such that a second frictional force acting between the edge and the second moving part, when the electronic device is biased in a direction away from the edge, such that the second portion of the electronic device biases in a direction away from the edge, causes the second moving part to bias toward the edge, thereby increasing a clamping force between the second moving part and the edge, and thereby increasing the second frictional force acting between the edge and the second moving part, and resisting the removal of the electronic device from the edge of the desk, table, or board, and wherein the second moving part is a second cam that rotates about an axis.

8. The electronic device of claim 7 further comprising at least a first arm projecting from the housing, wherein the first arm forms the first portion of the electronic device, and wherein the first cam and the second cam are located within the first arm.

9. The electronic device of claim 8 further comprising a second arm projecting from the housing, wherein the second arm forms the third portion of the electronic device.

10. The electronic device of claim 9 wherein the second arm comprises a pivot mount.

11. The electronic device of claim 7 further comprising a first arm projecting from the housing wherein the first arm forms the first portion of the electronic device, and a second arm projecting from the housing, wherein the second arm forms the third portion of the electronic device, wherein the first cam is located within the first arm and the second cam is located within the second arm.

12. The electronic device of claim 11 wherein the second arm comprises a pivot mount.

13. The electronic device of claim 12 wherein the electronic device is a power strip comprising multiple electrical receptacles and a power cord.

14. The electronic device of claim 1 wherein the first force-redirecting mechanism further comprises an inclined surface, wherein the inclined surface is inclined relative to at least one of the first portion or the third portion and the first moving part is a roller that rolls on the inclined surface wherein the first biasing element biases the roller into contact with the inclined surface and the edge of the desk, table, or board when the edge is in the void, wherein the roller and the inclined surface are configured such that the first frictional force acting between the edge and the roller, when the electronic device is biased in the direction away from the edge, in the direction such that the second portion of the electronic device is biased away from the edge, causes the roller to roll on the inclined surface toward the edge, thereby increasing the clamping force between the roller and the edge, and thereby increasing the first frictional force acting between the edge and roller, and thereby resisting the removal of the electronic device from the edge of the desk, table, or board.

15. The electronic device of claim 14 wherein the roller comprises a tubular elastomeric exterior surrounding a round inner pin, wherein the pin has a substantially higher modulus of elasticity than the elastomeric exterior.

16. The electronic device of claim 15 wherein the pin extends beyond the tubular elastomeric exterior on each end of the roller and each end of the pin is contained within a substantially triangular space in the housing.

17. The electronic device of claim 15 wherein the pin extends beyond the tubular elastomeric exterior on each end of the roller and wherein the first biasing element comprises two helical springs which press against two ends of the pin, biasing the roller against the inclined surface and into the void.

18. The electronic device of claim 14 further comprising an adjustable clamp that includes a first member that is threaded with external helical threads, a second member that is threaded with internal helical threads that are configured to mate with the external helical threads, and a rotatable knob for adjusting the clamp.

19. The electronic device of claim 1 wherein the electronic device is a power strip comprising multiple electrical receptacles and a power cord.

20. The electronic device of claim 1 wherein the electronic components comprise a surge suppressor.

21. A power strip configured to attach to and be mounted on an edge of a desk, table, or board, the power strip comprising:

a housing containing electronic components including multiple electrical conductors and multiple electrical receptacles;

a power cord electrically connected to the electronic components and physically attached to the power strip;

a first arm projecting from the housing;

an adjustable clamp that includes a first member that is threaded with external helical threads, a second member that is threaded with internal helical threads that are configured to mate with the external helical threads, and a rotatable knob configured to be used for adjusting the clamp;

an inclined surface, wherein the inclined surface is inclined relative to at least one of the housing or the first arm;

a roller that rolls on the inclined surface; and at least one biasing element positioned and configured to bias the roller against the inclined surface and away from at least one of the housing or the first arm wherein when the power strip is attached to the edge of the desk, table, or board, the roller contacts the edge of the desk, table, or board and resists removal of the power strip from the edge of the desk, table, or board.

22. The power strip of claim 21 wherein the roller comprises a tubular elastomeric exterior surrounding a round inner pin, wherein the pin has a substantially higher modulus of elasticity than the elastomeric exterior.

23. The power strip of claim 22 wherein the pin extends beyond the tubular elastomeric exterior on each end of the roller and each end of the pin is contained within a space in the housing.

24. The power strip of claim 22 wherein the pin extends beyond the tubular elastomeric exterior on each end of the roller and wherein the at least one biasing element comprises two helical springs which press against two ends of the pin.

25. The power strip of claim 21 further comprising a void configured to engage the edge of the desk, table, or board, wherein the void is defined by a first portion of the power strip, a second portion of the power strip, and a third portion of the power strip, wherein the second portion extends from the first portion to the third portion, the first portion is opposite of the third portion, and the void is between the first portion and the third portion; and wherein the first arm forms the first portion of the electronic device and the biasing element biases the roller into the void.

* * * * *